US007601019B2

(12) United States Patent
Hsieh et al.

(10) Patent No.: US 7,601,019 B2
(45) Date of Patent: Oct. 13, 2009

(54) ELECTRICAL CONNECTION SYSTEM

(75) Inventors: Shao C. Hsieh, Warren, OH (US); Mark D. McCall, Hubbard, OH (US)

(73) Assignee: Delphi Technologies, Inc., Troy, MI (US)

( * ) Notice: Subject to any disclaimer, the term of this patent is extended or adjusted under 35 U.S.C. 154(b) by 172 days.

(21) Appl. No.: 11/821,248

(22) Filed: Jun. 22, 2007

(65) Prior Publication Data

US 2008/0318460 A1 Dec. 25, 2008

(51) Int. Cl.
*H01R 4/50* (2006.01)

(52) U.S. Cl. ..... 439/345

(58) Field of Classification Search ..... 439/345, 439/845, 851, 855, 587, 589, 857, 224, 356, 439/595, 752, 352–355, 357, 358, 488, 489
See application file for complete search history.

(56) References Cited

U.S. PATENT DOCUMENTS 4,370,013 A * 1/1983 Niitsu et al. ..... 439/352
5,507,666 A * 4/1996 Yamanashi ..... 439/489
5,746,619 A 5/1998 Harting et al.
5,827,086 A 10/1998 Fukuda
5,947,763 A 9/1999 Alaksin
6,065,991 A 5/2000 Fukuda
6,250,945 B1 6/2001 Murakami et al.
6,485,337 B2 11/2002 Hsieh
6,514,098 B2 2/2003 Marpoe, Jr. et al.
6,533,601 B2 3/2003 Raudenbush et al.
6,692,316 B2 2/2004 Hsieh et al.
6,817,883 B2 11/2004 Raudenbush et al.
6,857,892 B2 2/2005 McLauchlan et al.
6,921,279 B2 7/2005 Sian et al.
6,962,502 B2 11/2005 Kind et al.
6,964,579 B2 11/2005 Seminara et al.
6,984,143 B2 1/2006 Roese
7,326,074 B1 * 2/2008 Lim et al. ..... 439/352

FOREIGN PATENT DOCUMENTS

DE 102005038167 2/2007

* cited by examiner

*Primary Examiner*—Edwin A. Leon
(74) *Attorney, Agent, or Firm*—Thomas N. Twomey

(57) ABSTRACT

A connection position assurance retainer may include mechanisms for retaining connectors. For example, a female connector and a male connector may be mated and retained. Male and female terminals, the female terminal including a terminal insert, may also be provided.

20 Claims, 16 Drawing Sheets

ELECTRICAL CONNECTION SYSTEM

BACKGROUND

Increased needs exist for connectors that can accommodate high current loads. For example, modern equipment may deploy electric motors requiring large amounts of current. Larger cables used to carry larger amounts of current may subject electrical contacts to more fretting and vibration damage than smaller cables required to carry lower amounts of current. Accordingly, connectors for larger cables may be more likely to suffer stress, and may be more likely to separate or break than connectors for smaller cables.

Connectors for larger cables used to accommodate higher power loads are often quite large. Such large connector sizes may be inconvenient or impractical for deployment in a confined environment, e.g., within a piece of equipment. Further, locking mechanisms for large connectors may be awkward, and may lack stability. In addition, connectors for large cables may be difficult to machine and/or to mold.

BRIEF DESCRIPTION OF THE DRAWING FIGURES

Figure 19:
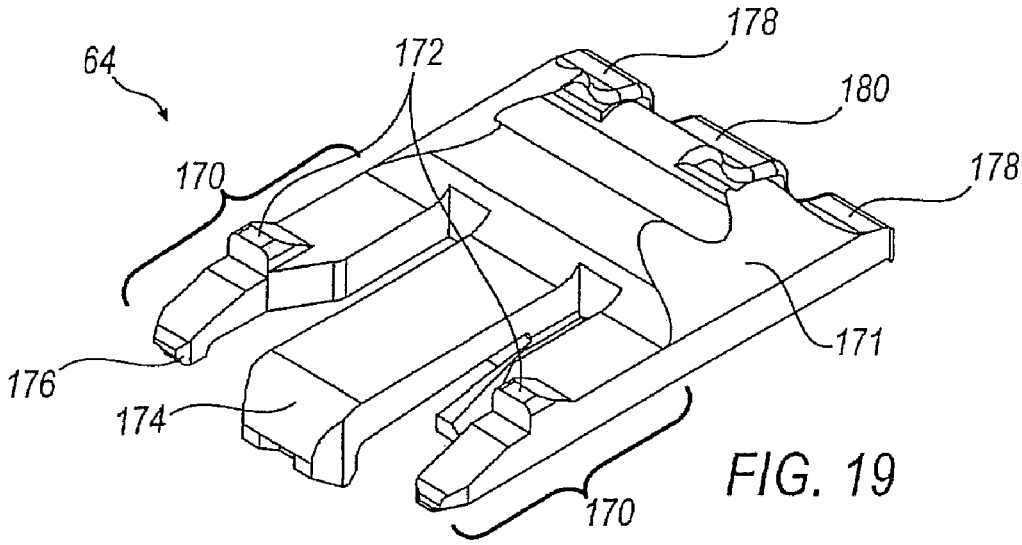

FIG. 19 provides a perspective view of an exemplary connector position assurance retainer.

Figure 20:
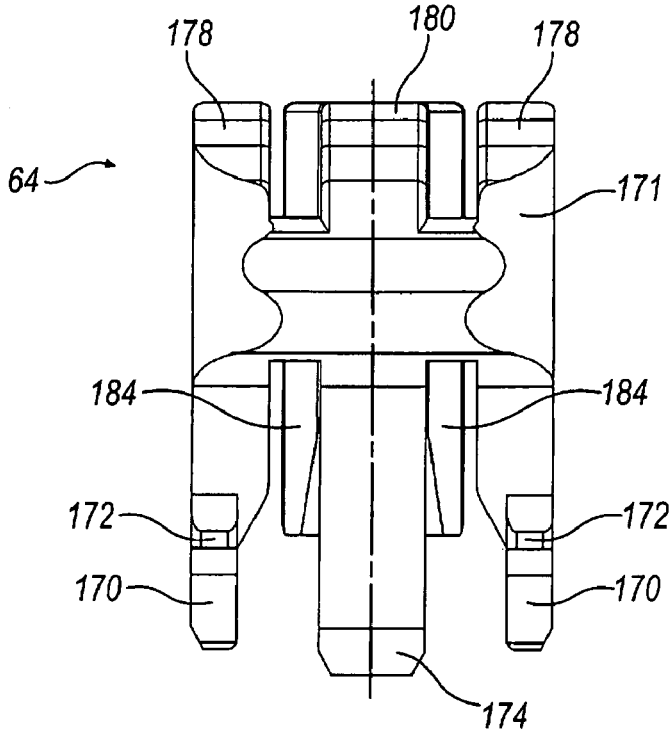

FIG. 20 provides a top view of an exemplary connector position assurance retainer.

Figure 21:
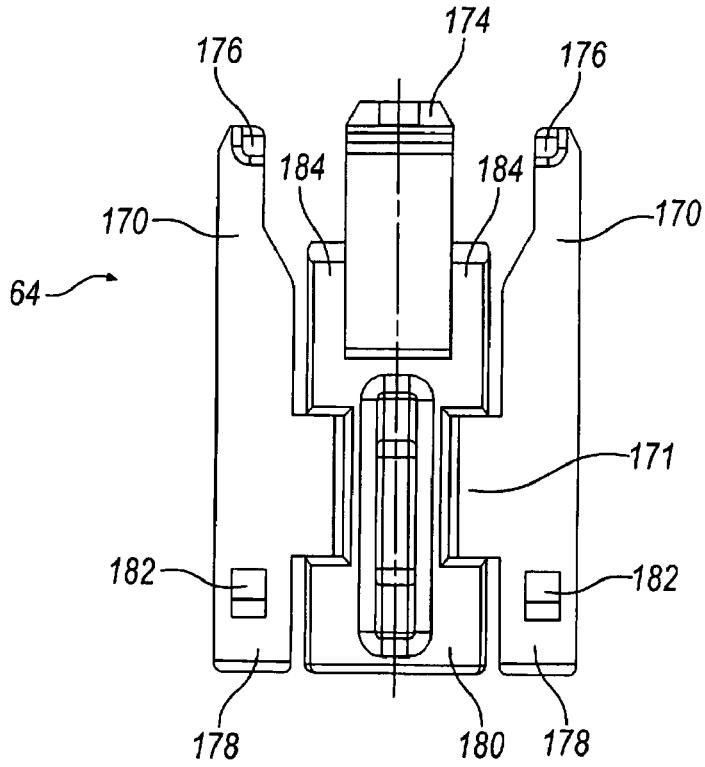

FIG. 21 provides a bottom view of an exemplary connector position assurance retainer.

Figure 22:
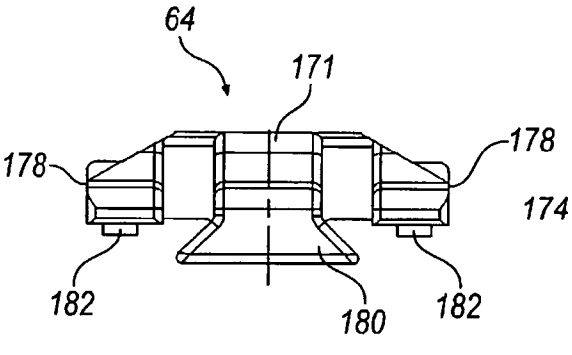

FIG. 22 provides a rear view of an exemplary connector position assurance retainer.

Figure 23:
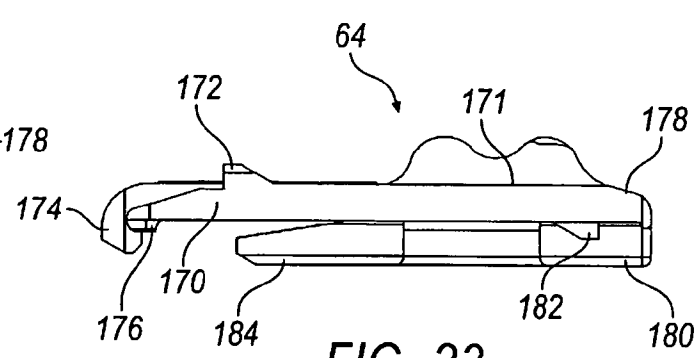

FIG. 23 provides a side view of an exemplary connector position assurance retainer.

Figure 24:
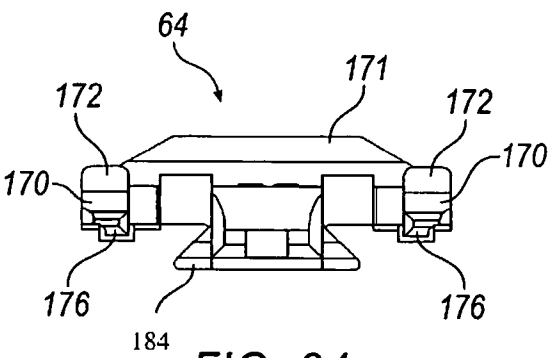

FIG. 24 provides a front view respectively of an exemplary connector position assurance retainer.

Figure 25:
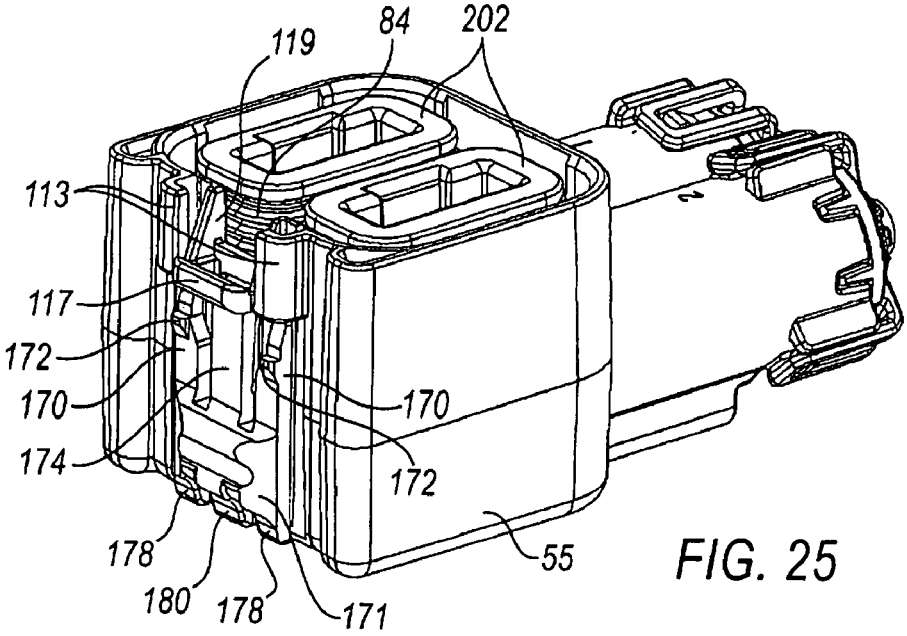

FIG. 25 illustrates a perspective view of an exemplary female connector having an exemplary connector position assurance retainer inserted in a pre-stage position.

Figure 26:
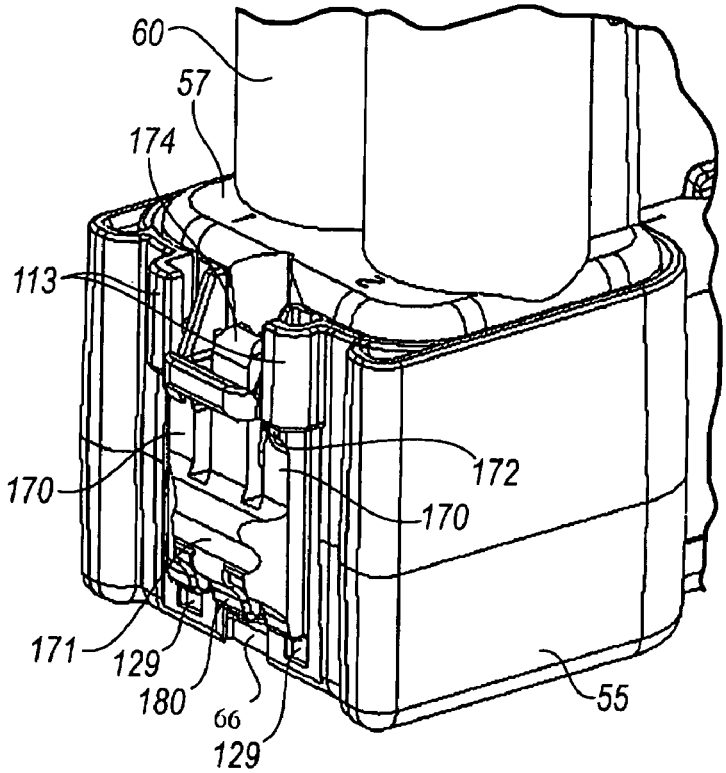

FIG. 26 illustrates a perspective view of an exemplary female connector mated to an exemplary male connector, the female connector having an exemplary connector position assurance retainer inserted and engaged in a locked or final position.

Figure 27:
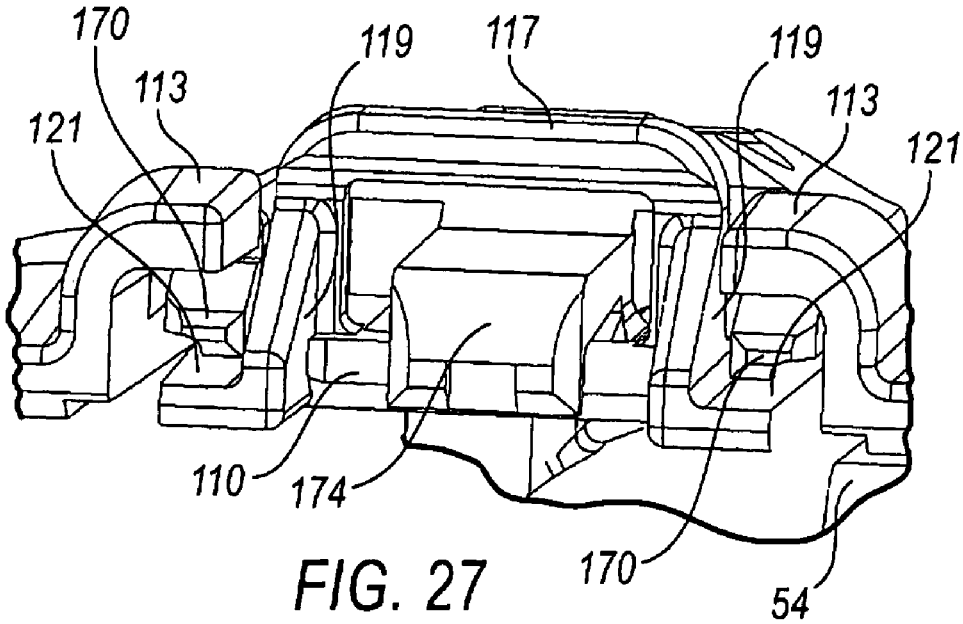

FIG. 27 illustrates a partial view of an exemplary connector position assurance retainer engaged in a final position to an exemplary female connector.

Figure 28:
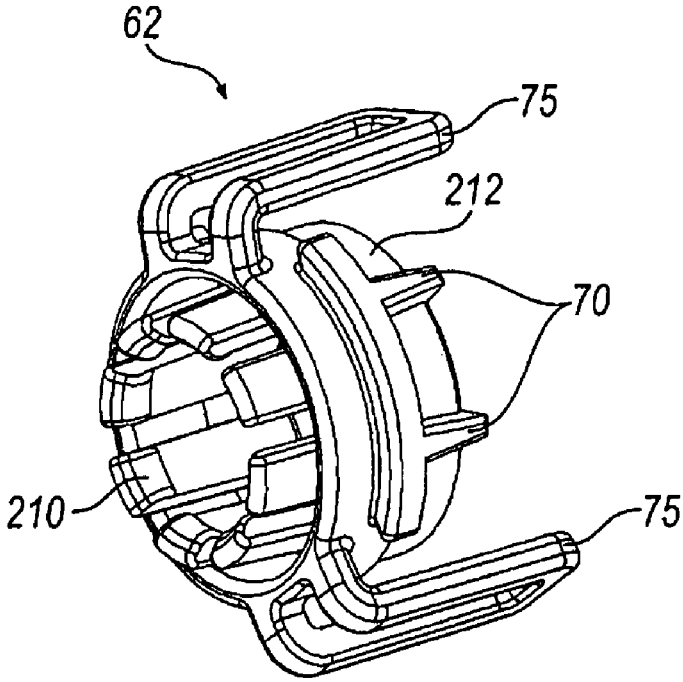

FIG. 28 is a perspective view of an exemplary terminal position assurance lock.

BRIEF SUMMARY

A connection position assurance system includes a connection position assurance retainer that having a dovetail tab mechanically engaged to a dovetail slot; a pair of back tabs on either side of, and substantially parallel to, the dovetail tab, each back tab having a back stop protruding downwardly therefrom; a pair of side tabs that are substantially parallel to one another; forward stops protruding upwardly from each of the side tabs, the side tabs extending beyond the forward stops; forward bumps protruding downwardly from a tip of each side tab; and a hook arm extending between, and substantially parallel to, the side tabs.

The connection position assurance system may further comprise a female connector including a top side that includes a pair of grooved arms flexibly extending in a substantially parallel fashion from a back side of the female connector, each grooved arm including a groove that has an edge that is spaced away from an end of the grooved arm; a slot formed by a space between the grooved arms; a hook bar that extends between the grooved arms and is substantially perpendicular thereto, the hook bar bounding one end of the slot, whereby the hook bar may serve as a forward stop for the connection position assurance retainer in a pre-stage position and as a back stop for the connection position assurance retainer in a final stage position; a pair of side walls, each side wall extending substantially perpendicularly from an end portion of one of the grooved arms, the hook bar extending between the end portions; and connector position assurance protector traps extending from the top side to form substantially right angles, the traps limiting movement of the grooved arms in an upward direction.

The dovetail tab may be inserted in the slot, and the back stops and the forward bumps may be seated in respective ones of the grooves, the connection position assurance retainer further including a pair of lower guide tabs extending below and within, and substantially parallel to, the side tabs. Further, the lower guide tabs may be inserted within the slot, the hook arm may be engaged with the hook bar, the side tabs may be inserted in respective spaces between the grooved arms and the traps, and each of the forward stops may abut one of the traps.

The connection position assurance system may further comprise a male connector including a top side having a locking bump protruding therefrom. The male connector may be inserted into the female connector, and the locking bump may be engaged by the hook bar.

DETAILED DESCRIPTION OF THE PREFERRED EMBODIMENTS

Overview of Connectors

A connection system may include a female connector formed to accommodate both a male connector and a connection position assurance retainer. The female connector includes grooved arms that accommodate forward bumps and backstops formed on the connection position assurance retainer. A hook at an end of a hook arm on the connection position assurance retainer, and a hook bar on the female connector, engage a locking bump on the male connector. When so engaged in what may be referred to as a final position, side tabs of the connection position assurance retainer enter connection position assurance protector traps on the female connector, to thereby limit movement of the grooved arms in an upward direction, and thereby preventing disengagement of the female and male connectors from one another. Prior to engagement in the final position, in a pre-stage position, the hook arm included in the connection position assurance retainer contacts the hook bar acting as a forward stop, thereby preventing forward progress of the connection position assurance retainer.

Figure 1:
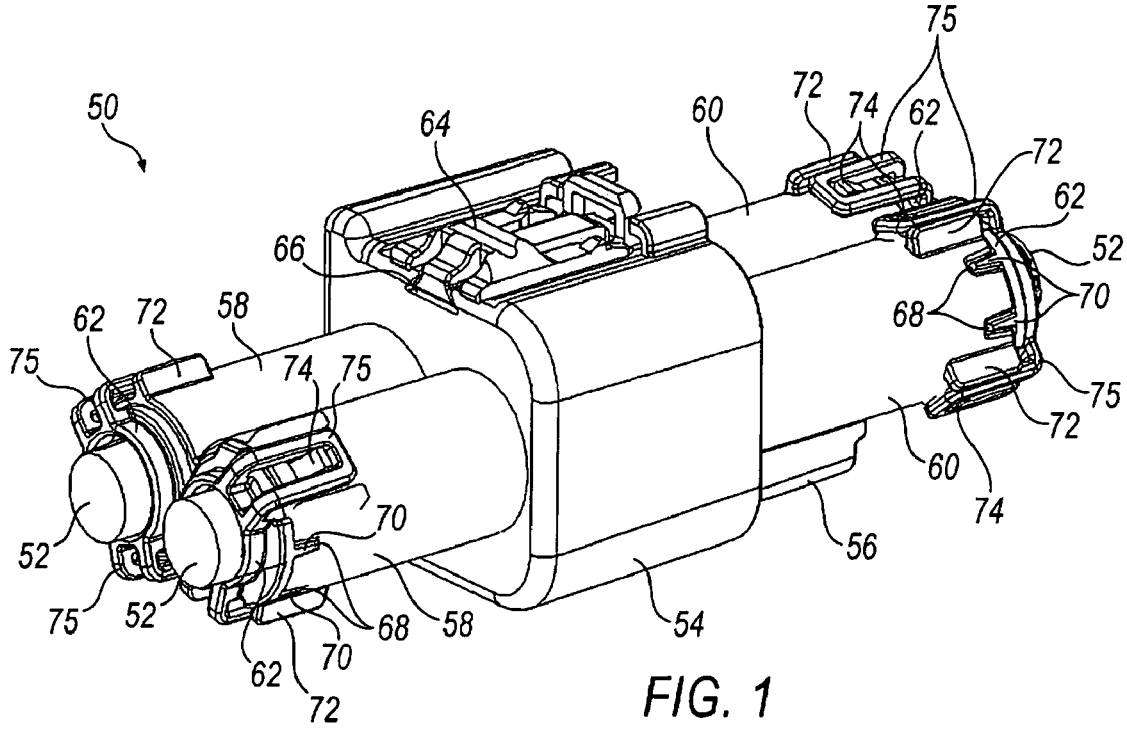
FIG. 1 illustrates a perspective view of an exemplary connection system, according to an embodiment.

FIG. 1 illustrates a perspective view of an exemplary connection system 50, according to an embodiment. As seen in FIG. 1, cables 52 are connected by the mating of an in-line female connector 54 and a male connector 56. Cables 52 enter female connector 54 via female terminal cylinders 58. Cables 52 enter male connector 56 via male terminal cylinders 60. Terminal position assurance (TPA) locks 62 provide a seal detainment and strain relief for cables 52 entering connectors 54 and 56.

A connector position assurance retainer (CPAR) 64 is used to retain connectors 54 and 56 in a mated position, as described in more detail below. CPAR 64 is retained at least in part by placement in a dovetail groove 66, as well as by other mechanisms described below. As seen in FIG. 1, CPAR 64 is in what is known as a "pre-stage" or "pre-staged" position. A "final" or "locked" position of CPAR 64 is described further below.

Terminal cylinders 58 and 60 each include two pairs of slots 68, the slots 68 generally disposed on opposing sides of the terminal cylinders 58 or 60, for receiving index ribs 70 of TPA locks 62. Lock bumps 74 are used to engage and secure lock arms 75 of TPA locks 62, as described further below. TPA locks 62 are further secured and positioned using ribs 72 on either side of lock bumps 74. Pairs of slots 68 and pairs of lock bumps 74 are generally disposed around terminal cylinders 58 and 60 in an opposing fashion, as seen in FIG. 1.

Figure 2:
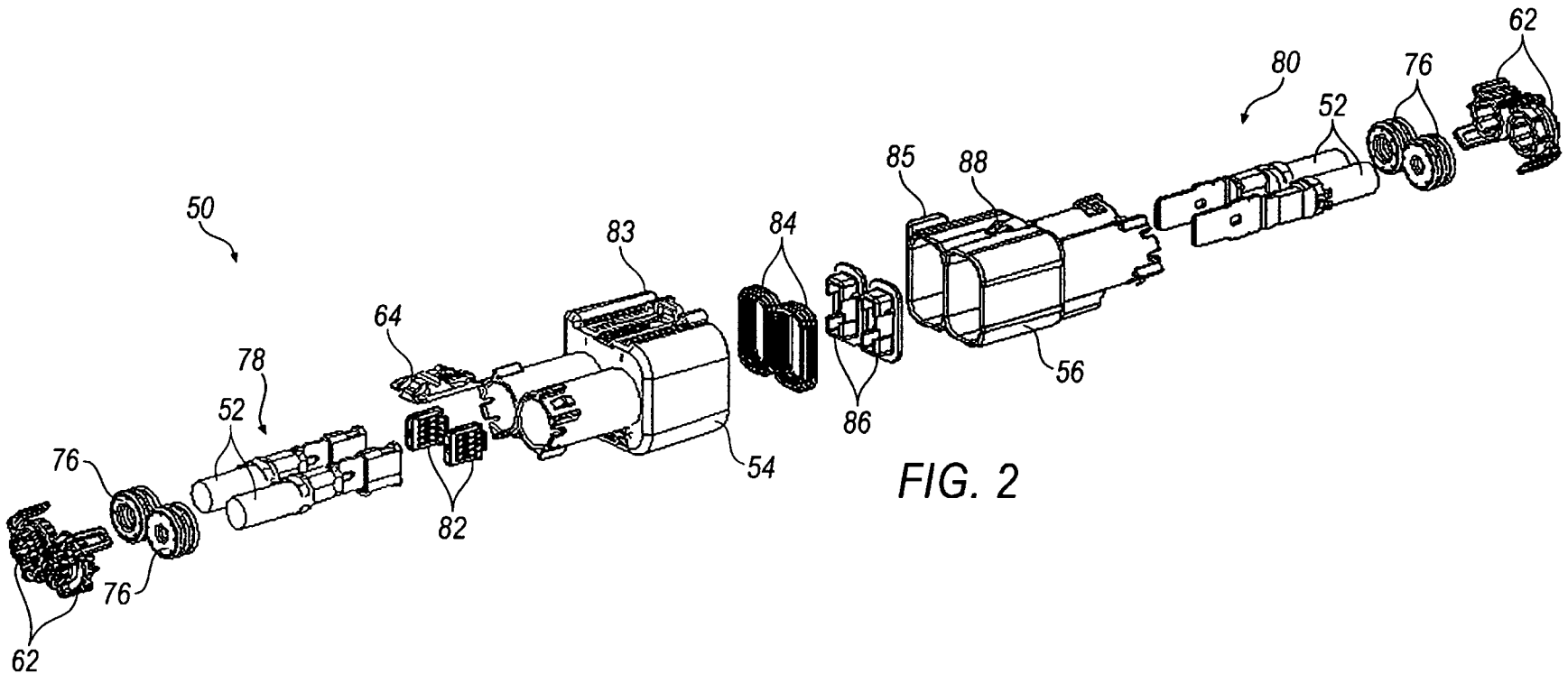
FIG. 2 illustrates an exploded view of the exemplary connection system of FIG. 1.
Figure 3:
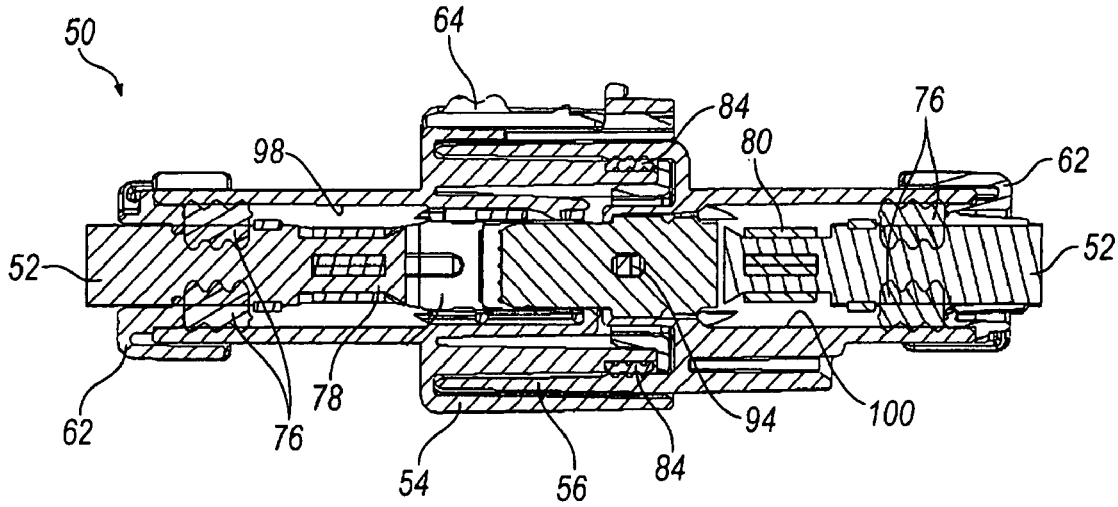
FIG. 3 illustrates a cross-sectional view of the exemplary connection system of FIG. 1.

FIG. 2 illustrates an exploded view of the exemplary connection system 50 of FIG. 1. FIG. 3 illustrates a cross-sectional view of the exemplary connection system 50 of FIG. 1. In general, with reference to FIGS. 2 and 3, TPA locks 62 encircle cables 52, and abut or nearly abut cable seals 76, which seals 76 also encircle cables 52. Wires in cables 52 are respectively electrically engaged with female terminals 78 and male terminals 80. In-line terminal inserts 82 may be seated within female terminals 78 to receive male terminals 80. Connector seals 84 receive in-line seal retainers 86, which seal retainers 86 serve to secure and hold in place connector seals 84, as described in more detail below. As may be seen in FIG. 2, male connector 56 includes a connector locking bump 88 that selectively engages CPAR 64, as is also described further below. Female connector 54 includes an index slot 83, which may receive an index tab 85 that extends from a side of male connector 56, thereby ensuring a proper orientation of male connector 56 to female connector 54 when connectors 54 and 56 are mated.

Figure 4:
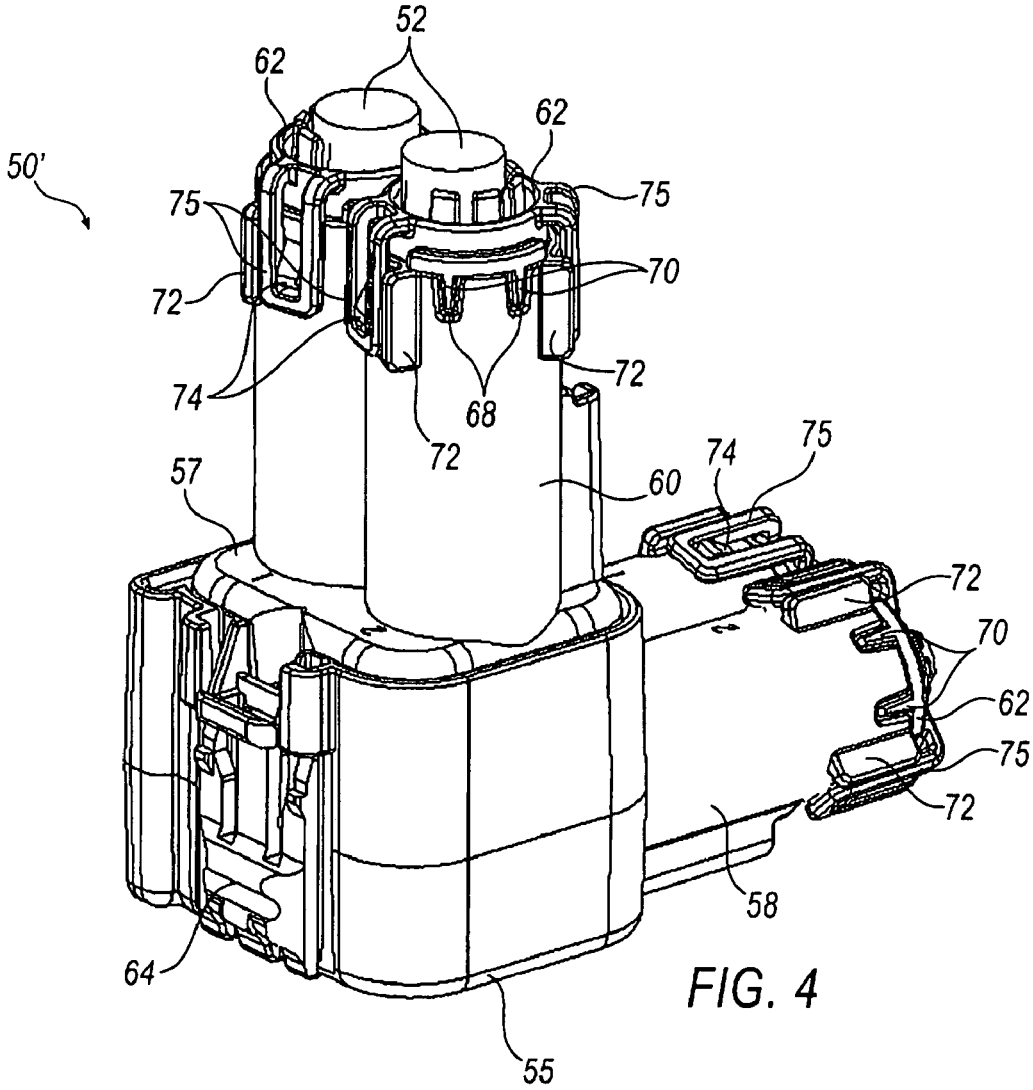
FIG. 4 illustrates a perspective view of an exemplary connection system, according to an embodiment.
Figure 5:
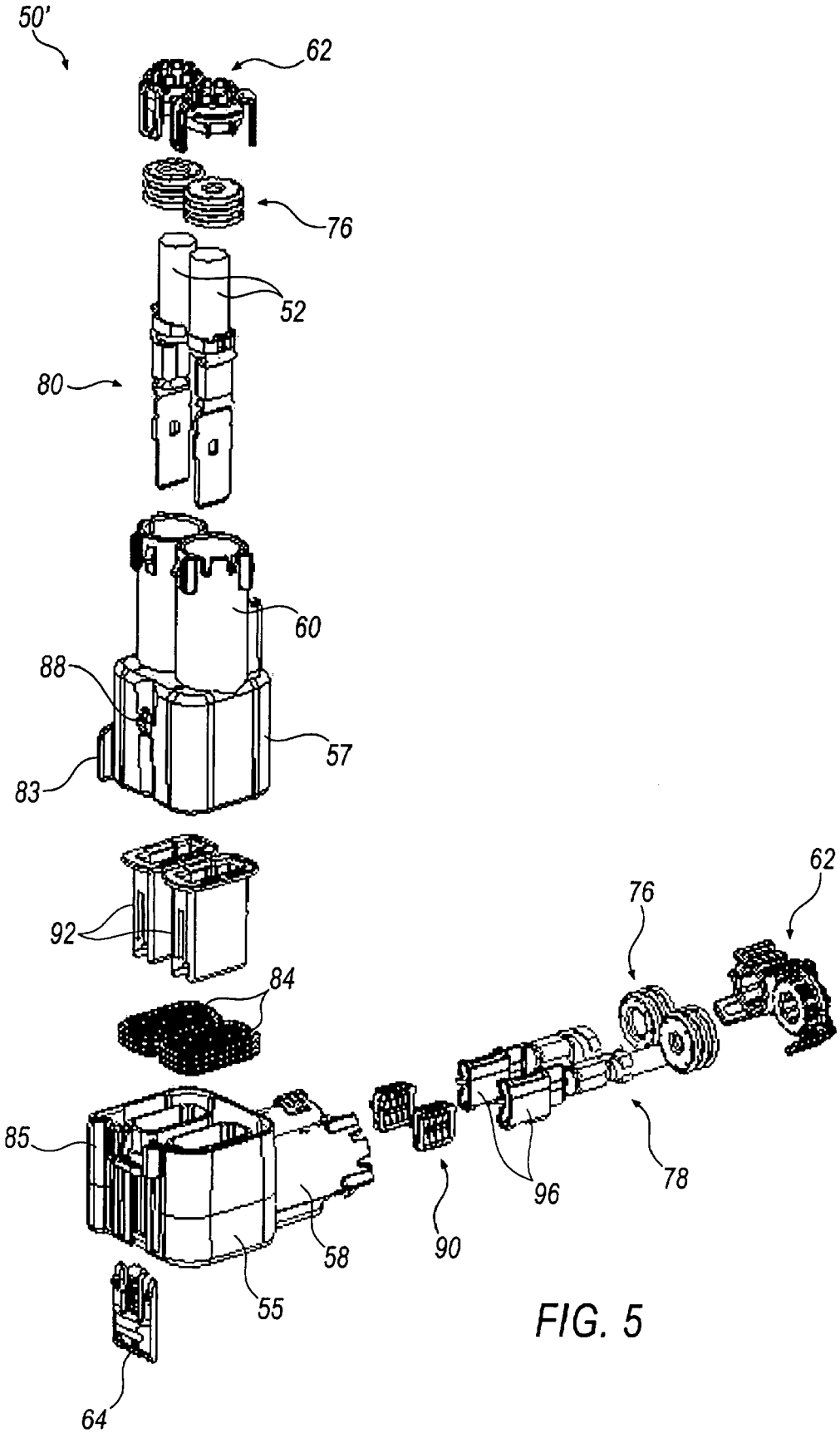
FIG. 5 illustrates an exploded view of the exemplary connection system of FIG. 4.
Figure 6:
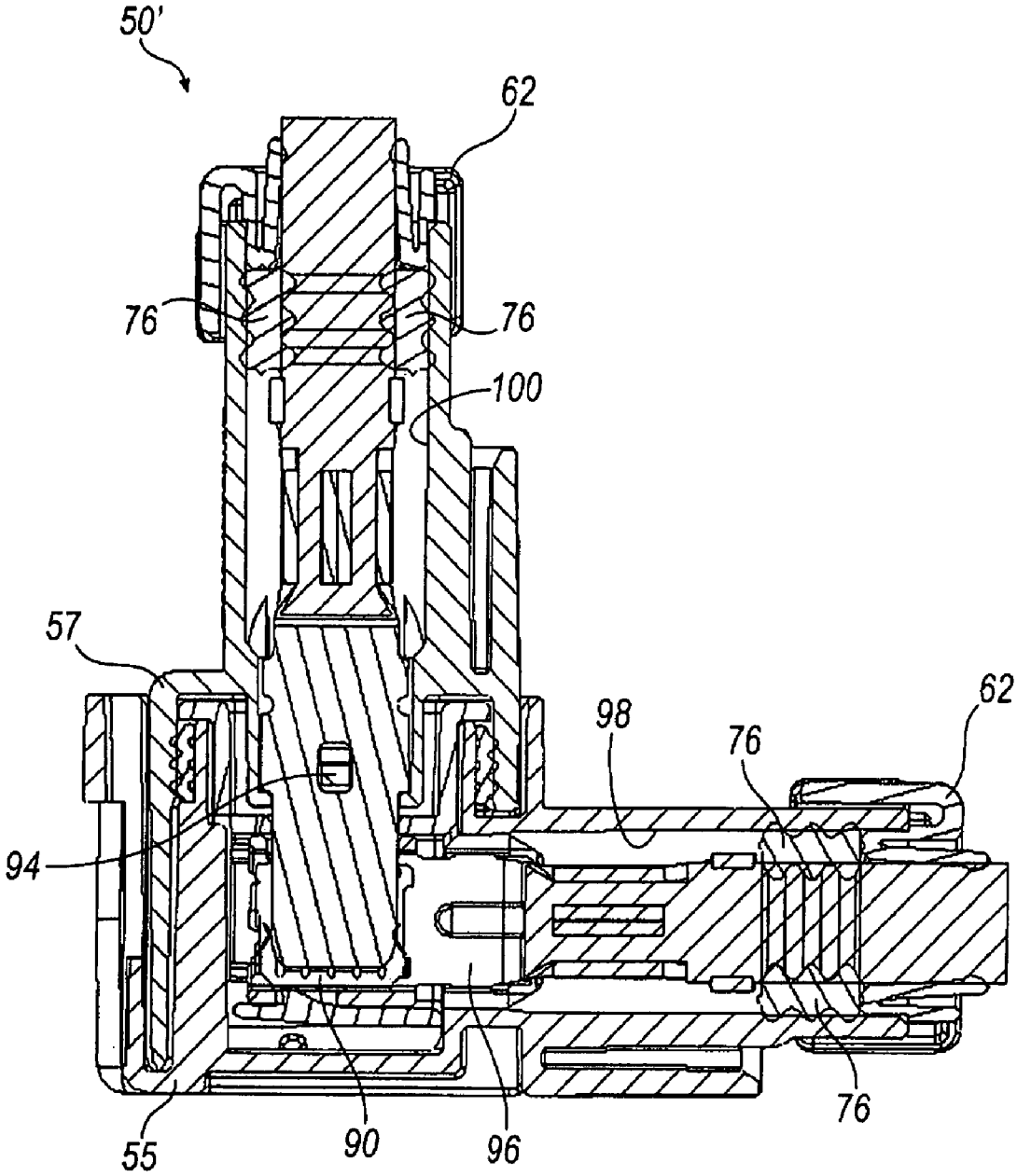
FIG. 6 illustrates a cross-sectional view of the exemplary connection system of FIG. 4.

FIGS. 4-6 illustrate views of an exemplary connection system 50', according to an embodiment. In contrast to connection system 50, discussed above with respect to FIGS. 1-3, in which connectors 54 and 56 are mated to be in-line or substantially in-line, in the exemplary connection system 50', a right angle female connector receives a male connector 57 to form a right, or substantially right, angle. Accordingly, FIG. 4 illustrates a perspective view of an exemplary connection system 50', according to an embodiment, in which female connector 55 receives male connector 57 at a substantially right angle. Male connector 57 is similar to male connector 56, but may be formed to accommodate the insertion of female terminals 78 in female connector 55, when male connector 57 is also inserted into female connector 55.

FIG. 5 illustrates an exploded view of the exemplary connection system 50'. FIG. 6 illustrates a cross-sectional view of the exemplary connection system 50'. As seen in FIGS. 5 and 6, components of system 50' not discussed above with respect to system 50 include right angle terminal inserts 90, and terminal lock seal retainers 92.

Further, as may be seen in FIGS. 3 and 6, male connectors 56 and 57 further include a terminal locking bump 94 that selectively engages male terminal 80 upon insertion of male terminal 80 into male connectors 56 and 57. A cable 52 is electrically engaged to female terminal 96 and is held in place by TPA 62, and is additionally contained by seal 76. Moreover, the cable 52 electrically engaged to female terminal assembly 78 is guided within an interior wall 98 of female terminal cylinder 58. A seal 76 is likewise contained within interior wall 98. Similarly, a cable 52, electrically engaged to male terminal 80, is guided within an interior wall 100 of male terminal cylinder 60. A seal 76 is likewise contained within the interior wall 100.

Figure 7:
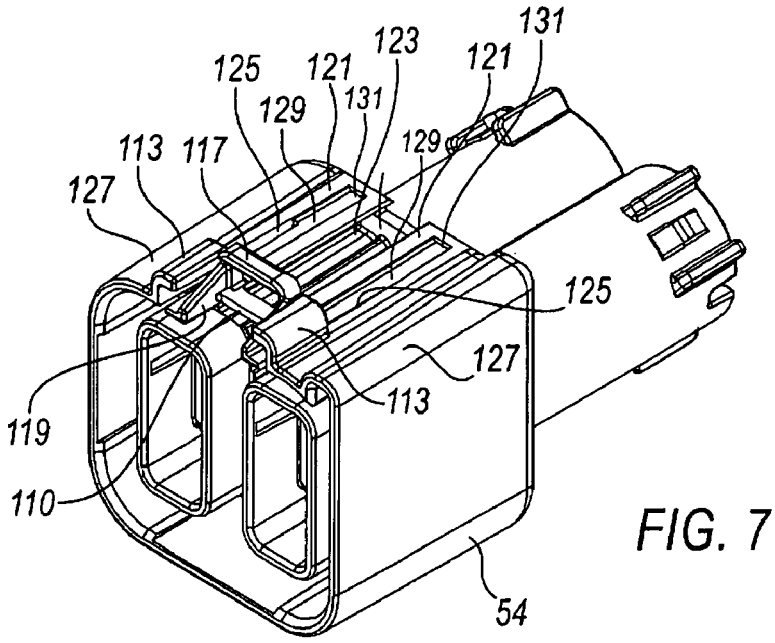
FIG. 7 illustrates a perspective view of an exemplary in-line female connector not having a connector position assurance retainer engaged therewith.
Figure 8:
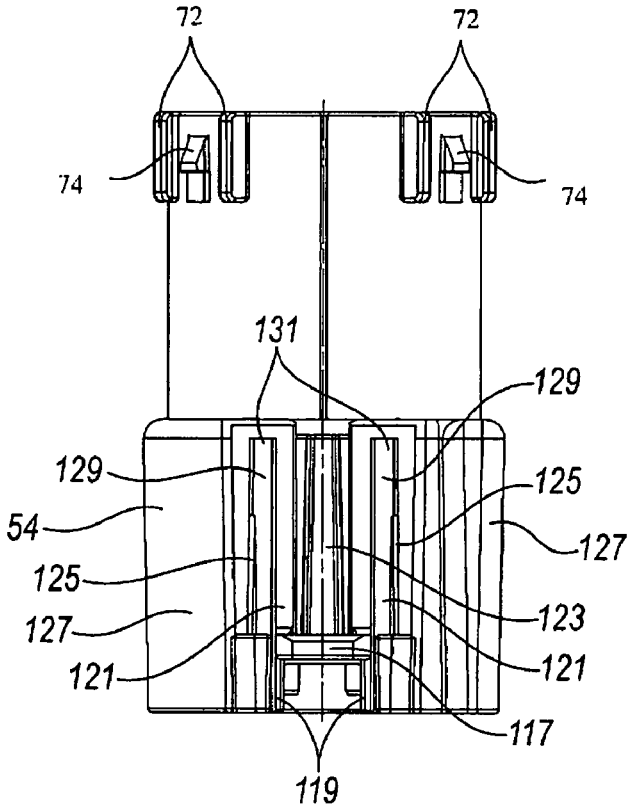
FIG. 8 illustrates a top view of an exemplary in-line female connector for having a connector position assurance retainer (not shown in FIG. 8) engaged therewith.

FIG. 7 illustrates a perspective view of an exemplary in-line female connector 54 not having a CPAR 64 engaged therewith. FIG. 8 illustrates a top view of an exemplary in-line female connector 54 not having a CPAR 64 engaged therewith. It is to be understood that illustrations similar to those provided with respect to FIGS. 7 and 8 could be provided with respect to an exemplary right-angle female connector 55.

With reference to FIGS. 7 and 8, connector 54 includes a pair of grooved arms 121 that are parallel or substantially parallel to one another and to a CPAR slot 123. Each grooved arm 121 includes a groove 129 that extends from a back edge 131 that is spaced from an end of the grooved arm 121. The CPAR slot 123 generally extends from dovetail groove 66 (not shown in FIGS. 7 and 8) to hook bar 110. A top brace 117 generally lies forward of, and above, hook bar 110 in a parallel or substantially parallel manner, both hook bar 110 and top brace 117 extending in a perpendicular or generally perpendicular manner between two side walls 119. As discussed further below, grooved arms 121 and CPAR slot 123 generally facilitate the operation of CPAR 64. A pair of slits 125 extend partway between grooved arms 121 and a main body 127 of female connector 54, thereby providing flexibility to grooved arms 121 and providing hook bar 110 and a top brace 117 with the ability to move up and down along an axis that is generally perpendicular to grooved arms 121.

Figure 9:
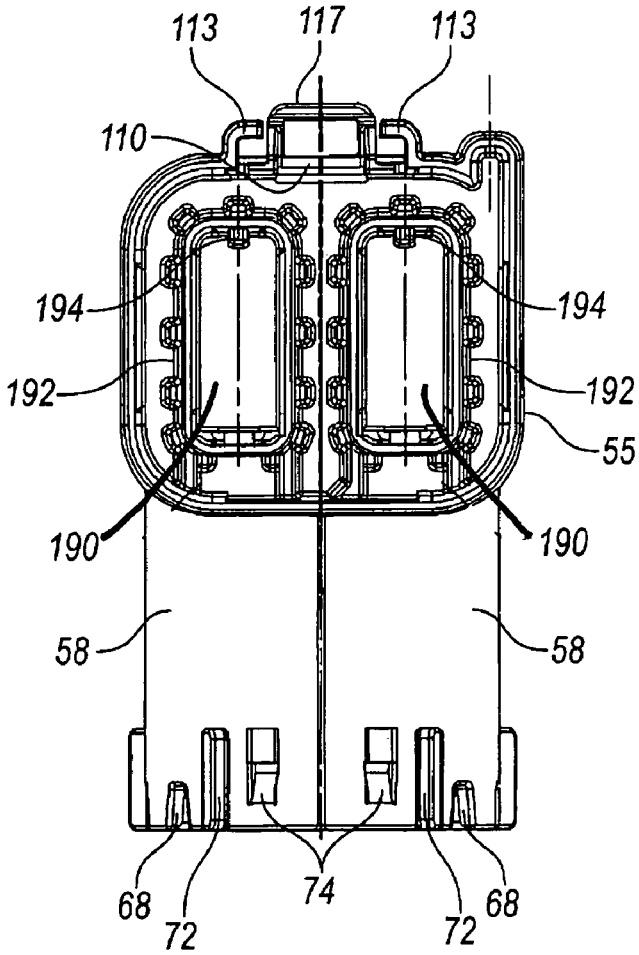
FIG. 9 illustrates a top view of an exemplary right angle female connector.

FIG. 9 illustrates a top view of an exemplary right angle female connector 55. A pair of terminal openings 190 are respectively connected to terminal cylinders 58 on a first end and to terminal receptacles 192 on a second end. Terminal receptacles 192 generally include an indexing rib 194 on a side furthest from terminal openings 190.

Figure 10:
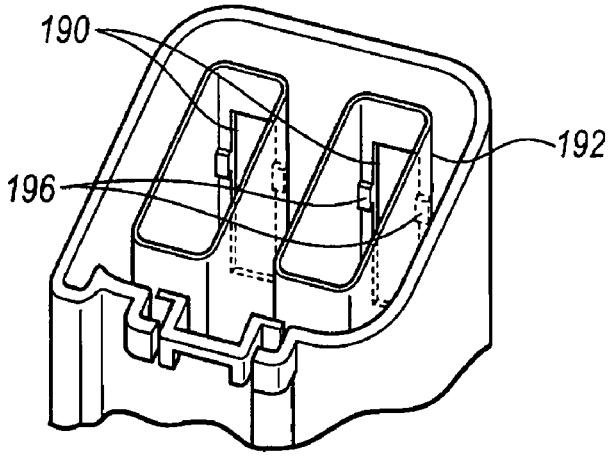
FIG. 10 illustrates an exemplary female terminal receptacle.

FIG. 10 illustrates a perspective view of an exemplary terminal receptacle 192. The perspective illustrated in FIG. 10 looks into terminal opening 190. Notches 196 are cut into a wall of terminal receptacle 192 around opening 190 to accommodate terminal lock seal retainer 92 as discussed below.

Terminal Lock Seal Retainer

Figure 11:
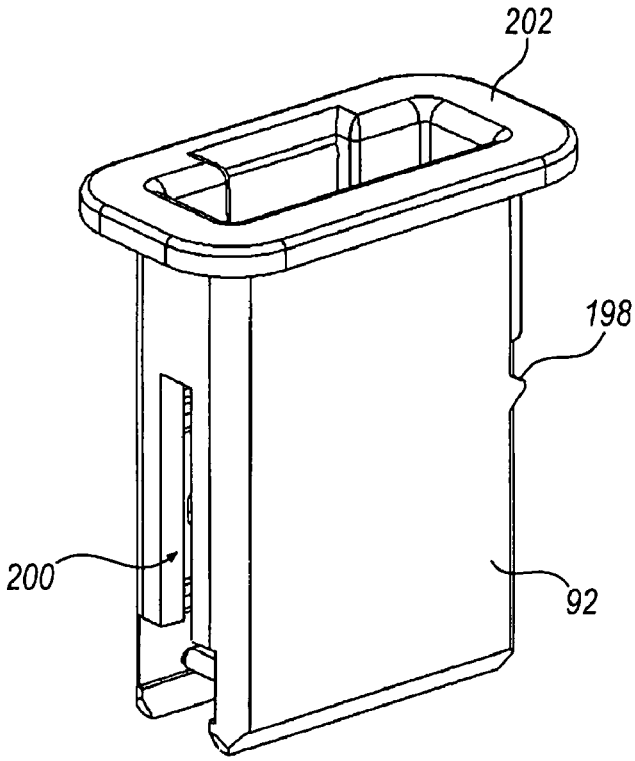
FIG. 11 illustrates a perspective view of an exemplary terminal lock seal retainer.

FIG. 11 illustrates a perspective view of an exemplary terminal lock seal retainer (TLSR) 92. A lock bump 198 is designed to engage with notch 196 (shown in FIG. 10) to thereby secure TLSR 92 to female connector 55. TLSR 92 generally includes a pair of lock bumps 198, although only one lock bump 198 can be seen from the perspective illustrated in FIG. 11. An index slot 200 is included to accommodate indexing rib 194. Accordingly, indexing rib 194 within terminal receptacle 192 (see FIG. 9) is generally of an appropriate height to accommodate index slot 200. For example, indexing rib 194 may be about ⅔ to ¾ the height of terminal receptacle 192. A flange 202 may be included for the purpose of retaining connector seals 84.

Figure 12:
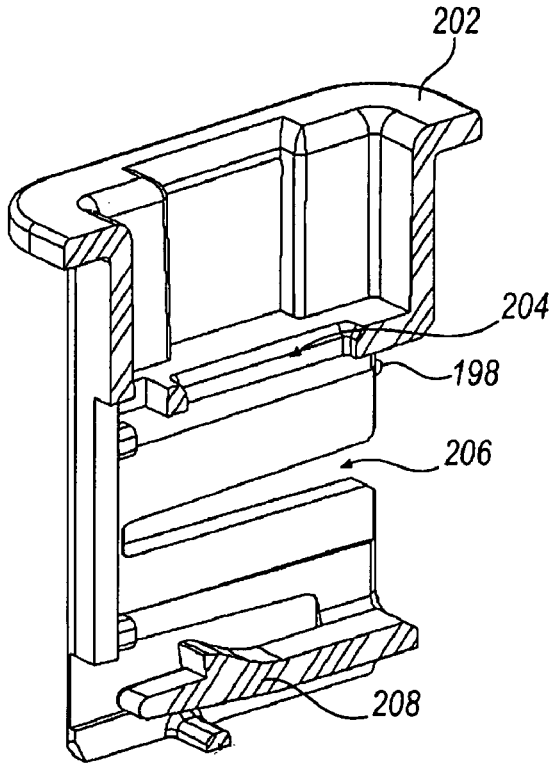
FIG. 12 illustrates a cross-sectional view of an exemplary terminal lock seal retainer.
Figure 16:
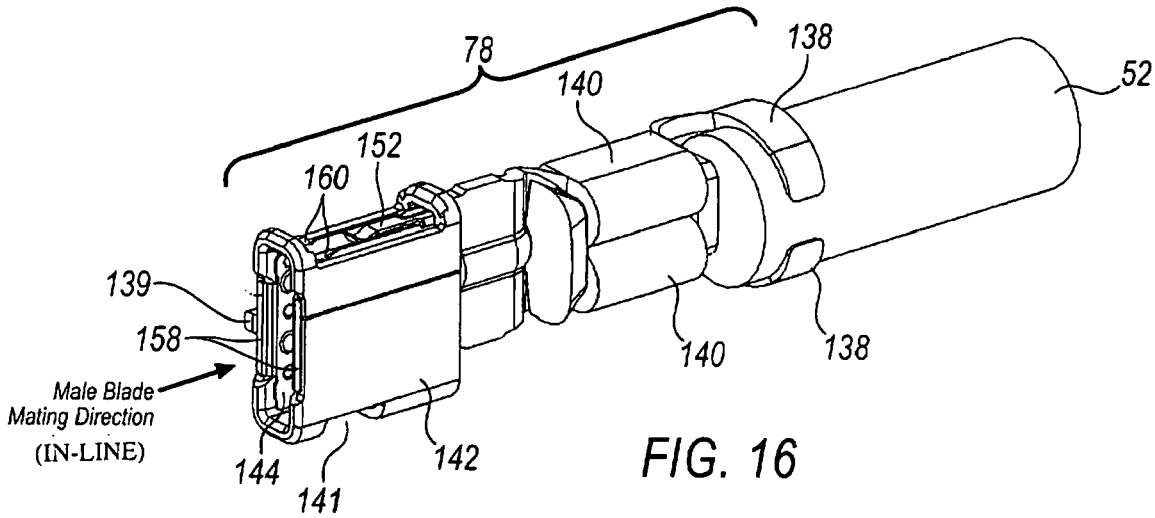
FIG. 16 illustrates a perspective view of an exemplary in-line female terminal assembly and a cable.

FIG. 12 illustrates a cross-section view of an exemplary terminal lock seal retainer 92. A male terminal blade slot 204 may accommodate male blade 126, discussed below with reference to FIG. 13. A female receptacle index slot 206 is provided to accommodate index tab 139 provided on female receptacle 142, discussed below with reference to FIG. 14. Female terminal assembly lock 208 is provided to engage notch 141, discussed below with reference to FIG. 16, provided on female receptacle 142. Lock 208 is generally ramped or inclined to ease the engagement of lock 208 with notch 141.

Terminals

Figure 13:
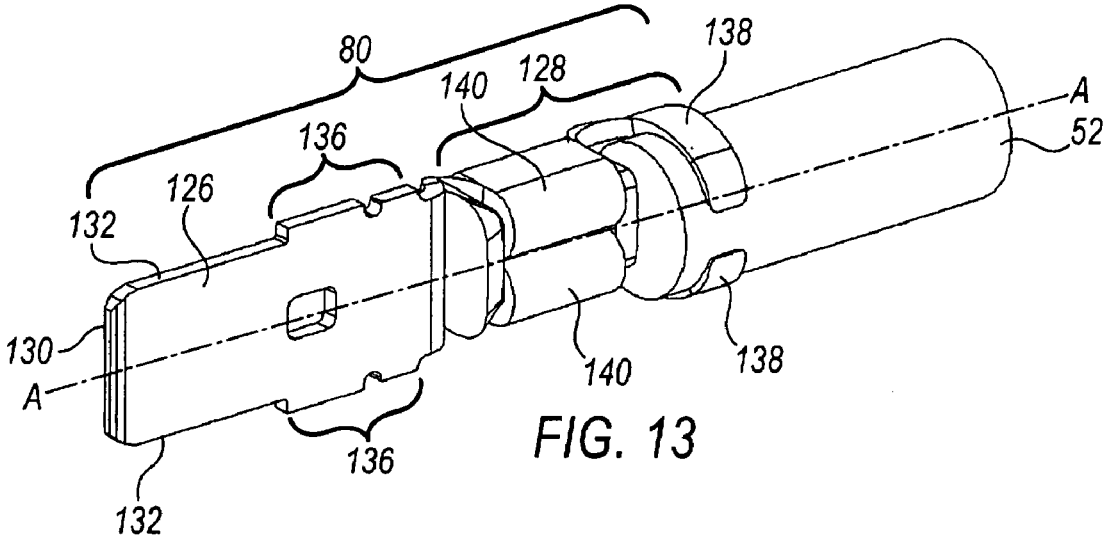
FIG. 13 illustrates a perspective view of an exemplary male terminal electrically engaged with a wire.

FIG. 13 illustrates a perspective view of an exemplary male terminal 80 electrically engaged with wires in a cable 52. A male blade 126 extends longitudinally along an axis A from a terminal base 128. Male blade 126 includes a tip 130 at points of male blade 126 that are a furthest distance from the base 128, and edges 132 that are substantially parallel to axis A, and substantially perpendicular to tip 130. Male blade 126 further includes a terminal lock window 134, generally located a same distance from the tip 130 as first ends of positioning ridges 136. Second ends of positioning ridges 136 may represent a transition of terminal 80 from blade 126 to base 128. Cable 52 and wires included therein may be held in place by cable crimps 138 and wire crimps 140.

Figure 14:
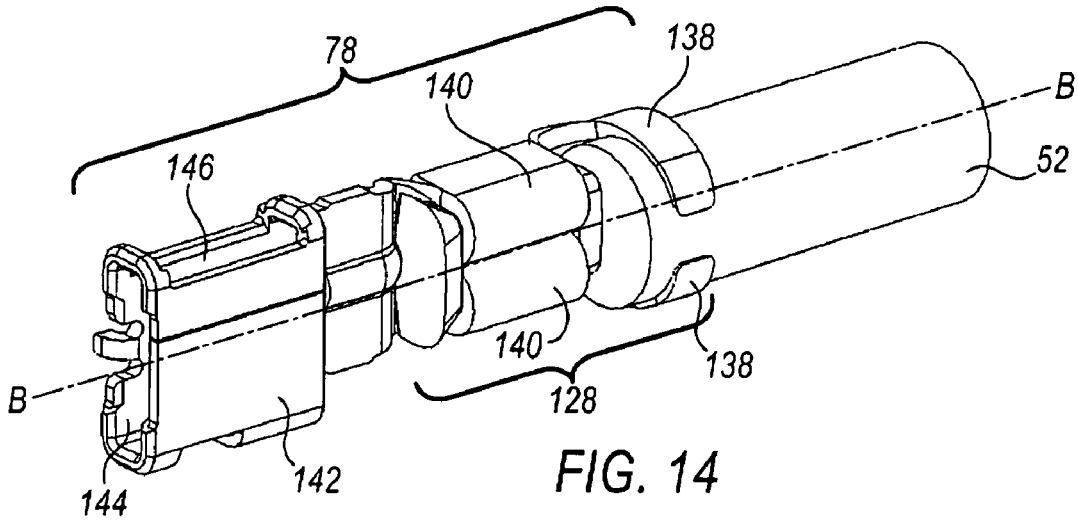
FIG. 14 illustrates a perspective view of an exemplary female terminal electrically engaged with a wire.

FIG. 14 illustrates a perspective view of an exemplary female terminal assembly 78 electrically engaged with wires in a cable 52. A female receptacle 142 extends longitudinally along an axis B from a terminal base 128. Female receptacle 142 includes an in-line blade opening 144 and a right angle blade opening 146.

Terminal Inserts

Figure 15:
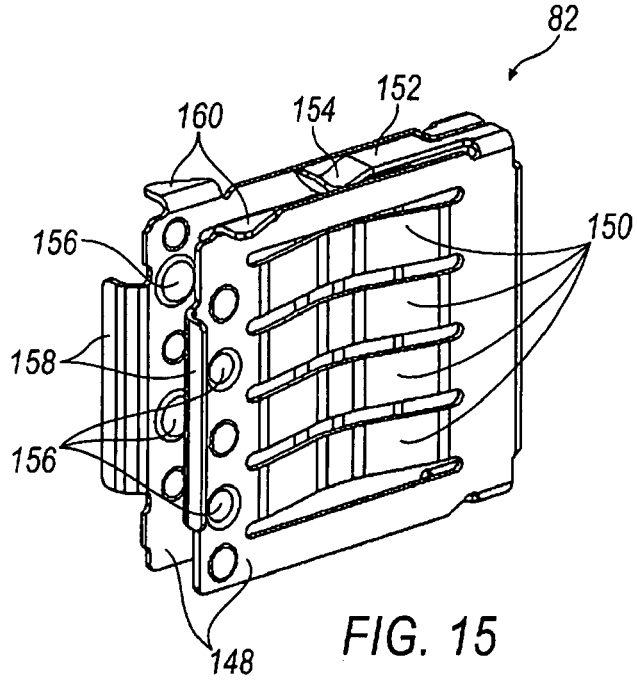
FIG. 15 illustrates a perspective view of an exemplary in-line terminal insert.

FIG. 15 illustrates a perspective view of an in-line terminal insert 82, which is configured to receive male blade 126 (see, e.g., FIG. 13), and to fit snugly into female receptacle 142 through opening 144 (see, e.g., FIG. 14). FIG. 16 illustrates a perspective view of an in-line female terminal assembly 78 and a cable 52, including terminal insert 82 shown inserted into female receptacle 142 through opening 144. When terminal insert 82 is inserted into female receptacle 142, the insert 82 may receive male blade 126 in a direction as illustrated in FIG. 16. An indexing tab 139 is provided to facilitate the insertion of female receptacle 142 into female connector 54 or 55, as further described below. A notch 141 is provided to engage and secure female receptacle 142, as is also further described below.

Returning to FIG. 15, terminal insert 82 includes two side panels 148, each panel 148 having a plurality of contact arms 150, which contact arms 150 are flexibly indented in an inward direction to promote contact with male blade 126 when male blade 126 is inserted into terminal insert 82. Terminal insert 82 further includes two side contacts 152 (only one of which is shown in FIG. 15) to restrain and prevent a side to side or lateral movement of male blade 126. An inwardly curved tip 154 of contact 152 promotes contact with and secure positioning of blade 126, thereby minimizing the potential for damage caused due to fretting and vibration. Contact dimples 156 included in each side panel 148 further stabilize male blade 126, thereby contributing to the minimization of potential fretting and vibration damage.

A curvilinear flange 158 protrudes outwardly from a top edge of each side panel 148. A side tab 160 protrudes outwardly from a side of each side panel 148, generally only on one side of side panel 148, and generally above side contact 152. As is best illustrated in FIG. 16, flanges 158 and side tabs 160 serve to position and restrain insert 82 within female receptacle 142.

Figure 17:
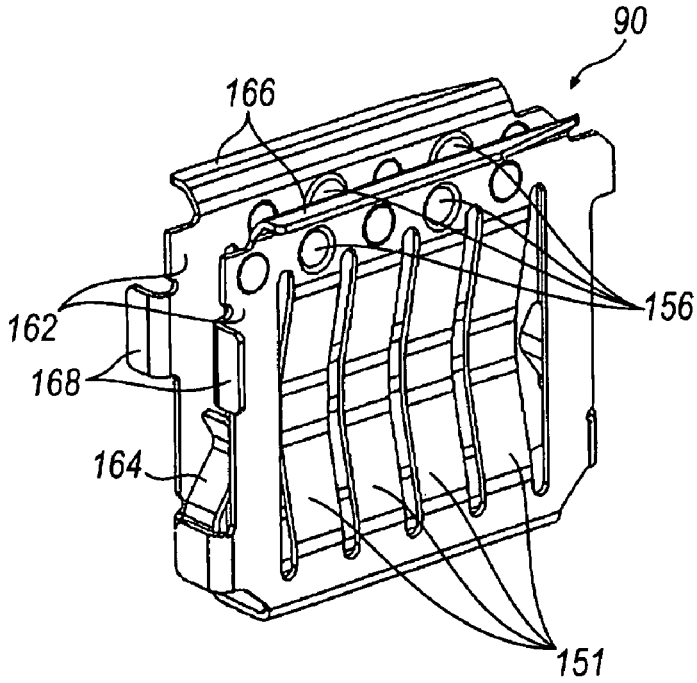
FIG. 17 illustrates a perspective view of an exemplary right angle terminal insert.
Figure 18:
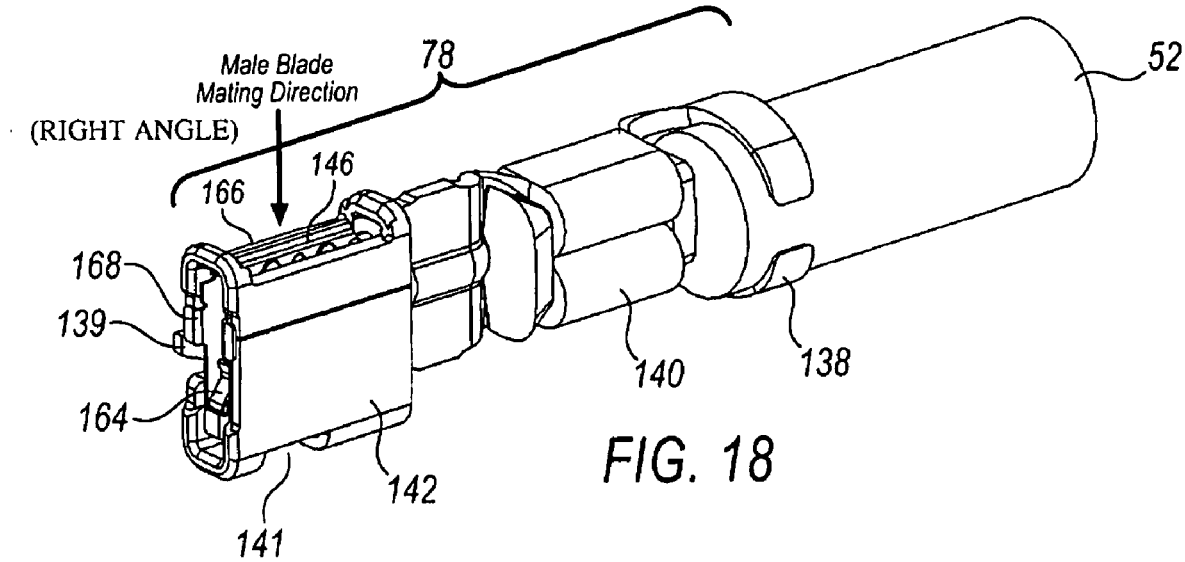
FIG. 18 illustrates a perspective view of an exemplary right-angle female terminal assembly and a cable.

FIG. 17 illustrates a perspective view of a right angle terminal insert 90, which is configured to receive male blade 126 (see, e.g., FIG. 13), and to fit snugly into female receptacle 142 through opening 144 (see, e.g., FIG. 14). FIG. 18 illustrates a perspective view of right-angle female terminal assembly 78 and a cable 52, including terminal insert 90 shown inserted into female receptacle 142 through opening 144. When terminal insert 90 is inserted into female receptacle 142, the insert 90 may receive male blade 126 in a direction as illustrated in FIG. 18. An indexing tab 139 is provided to facilitate the insertion of female receptacle 142 into female connector 54 or 55, as further described below. A notch 141 is provided to engage and secure female receptacle 142, as is also further described below.

Returning to FIG. 17, terminal inserts 90 include two side panels 162, each panel 162 having a plurality of contact arms 151, which contact arms 151 are flexibly indented in an inward direction as described above with reference to FIG. 15, and which thereby promote contact with male blade 126 when male blade 126 is inserted into terminal insert 90. Terminal insert 90 further includes two side contacts 164 (only one of which is shown in FIG. 17) to restrain and prevent a side to side or lateral movement of male blade 126, and to promote contact with and secure positioning of blade 126, thereby minimizing the potential for damage caused due to fretting and vibration. Side panels 162, like side panels 148, include dimples 156 to further stabilize male blade 126, thereby contributing to the minimization of potential fretting and vibration damage.

A curvilinear flange 166 protrudes outwardly from a top edge of each side panel 162. A side tab 168 protrudes outwardly from a side of each side panel 162, generally only on one side of side panel 162, and generally above side contact 164. As is best illustrated in FIG. 18, flanges 166 and side tabs 168 serve to position and restrain insert 90 within female receptacle 142.

Connector Position Assurance

FIG. 19 provides a perspective view of an exemplary CPAR 64. FIGS. 20 and 21 provide top and bottom perspective views of an exemplary CPAR 64 respectively. FIGS. 22, 23, and 24 provide rear, side, and front perspective views respectively of an exemplary CPAR 64. With reference to FIGS.

19-24, CPAR 64 includes two side tabs 170 extending from a base portion 171. Side tabs 170 include forward stops 172 protruding upwardly therefrom, and forward bumps 176, protruding downwardly from a tip thereof. When CPAR 64 is in a final stage or locked position, forward stops 172 are generally engaged with or abutting CPAR traps 113 (shown in FIG. 9). Forward bumps 176 are generally seated within grooved arms 121, thereby guiding the movement of CPAR 64 from a pre-stage position to a final stage or locked position.

A hook arm 174 extends from base portion 171 and is disposed between side tabs 170 in a parallel or substantially parallel manner. Hook arm 174 generally engages hook bar 110 (shown in FIG. 7) when CPAR 64 is in a final stage or locked position. However, in a pre-staged position, the front of the hook arm 174 also serves as forward stop abuts a rear side of the hook bar 110, whereby a hook at the end of hook arm 174 may be forced upward by the male connector lock bump 88 when connectors 54 or 55 are respectively engaged with connector 56 or 57 in a final stage position. Back tabs 178 extend rearwardly from base portion 171, having back stops 182 protruding downwardly therefrom. A dovetail tab 180 extends from base portion 171 and is disposed between back tabs 178 in a parallel or substantially parallel manner. Dovetail tab 180 has a triangular-like shape to fit within dovetail groove 66 (shown in FIG. 1). Lower guide tabs 184 generally extend below and between side tabs 170.

When CPAR 64 is engaged with a female connector 54 or 55, lower guide tabs 184 and dovetail tab 180 generally engage the connector 54 or 55 on a bottom side of slot 123, while side tabs 170 and back tabs 178 move along a top side of slot 123. Bumps 176 and 182 may be seated in grooved arms 121 and thereby serve to help guide the movement of CPAR 64 longitudinally along the connector 54 or 55.

FIG. 25 illustrates a perspective view of an exemplary right angle female connector 55 having a CPAR 64 inserted in a pre-stage position. As can be seen, front of hook arm 174 is against leading face of hook bar 110, therefore preventing CPAR 64 from moving forward. Back tabs 178 and dovetail 180 are flush or substantially flush with a side of the connector 55. Although not visible in FIG. 25, back stops 182 catch on a rear edge of grooved arms 121, the grooved arms 121 being shown in FIGS. 7 and 8, thereby preventing CPAR 64 from "backing out" of slot 123, i.e., from slipping in a direction away from hook bar 110 and top brace 117.

FIG. 26 illustrates a perspective view of an exemplary right angle female connector 55 mated to a male connector 57, the female connector 55 having a CPAR 64 inserted and engaged in a locked or final position. When male connector 57 is inserted into female connector 55, bump 88 (shown in FIGS. 2 and 5 but not visible in FIG. 26) on male connector 57 engages with and catches on a side of hook bar 110 closest to dovetail 180. Bump 88 is generally sloped, e.g., at a thirty degree or forty-five degree angle or the like, in a direction facing away from terminal cylinders 60. However, in a direction facing terminal cylinders 60, bump 88 generally presents a vertical or substantially vertical face, i.e., a generally ninety degree angle with respect to a plane defined by a surface of male connector 57 on which bump 88 is situated. The sloped or ramped configuration of bump 88 allows for hook bar 110, located between flexible grooved arms 121, to be slid over bump 88 when male connector 57 is inserted into female connector 55. However, the vertical or substantially vertical face of bump 88 easily engages with and is secured against hook bar 110.

Once male connector 57 has been so inserted into female connector 55, CPAR 64 may be moved into its locked or final position, i.e., when the bump 88 has raised the front of the hook arm 174 above the hook bar 110. Accordingly, when compared to its position as illustrated in FIG. 25, CPAR 64 has been moved in a direction governed by grooved arms 121 and slot 123 (not visible in FIG. 26) so that forward stops 172 abut CPAR traps 113, hook arm 174 is engaged with hook bar 110 (not visible in a FIG. 26), and side tabs 170 slide into CPAR traps 113. Thus, when CPAR 64 is in a locked position, engagement of both hook arm 174 and bump 88 with hook bar 110 prevent disengagement of male connector 57 and female connector 55. Further, as seen, for example, in FIG. 27, side arms 170, and confinement of ends of side arms 170 between grooved arms 121 and CPAR traps 113, prevent grooved arms 121 from being moved in a direction away from male connector 57, and thereby prevent disengagement of hook arm 174 and bump 88 from hook bar 110.

It is to be understood that the illustrations of an exemplary right angle female connector 55 provided in FIGS. 25 and 26 could be provided with respect to an exemplary in-line female connector 54.

Terminal Position Assurance Lock

FIG. 28 is a perspective view of a terminal position assurance (TPA) lock 62, according to an embodiment. A pair of arms 75 generally are opposite one another around a circumferential portion 212 of TPA 62. Similarly, a pair of index ribs 70 is disposed around a circumference of TPA 62. A plurality of fingers 210, generally numbering around eight in quantity, are disposed within and extend from the circumference of TPA 62, and may be used to secure and provide stress relief for a cable 52.

CONCLUSION

The above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "said," etc. should be read to recite one or more of the indicated elements unless a claim recites an explicit limitation to the contrary.

What is claimed is:

1. A connection position assurance system, comprising a connection position assurance retainer that includes:

a dovetail tab configured to mechanically engage a dovetail slot;

a pair of back tabs on either side of, and substantially parallel to, the dovetail tab, each back tab having a back stop protruding downwardly therefrom;

a pair of side tabs that are substantially parallel to one another;

forward stops protruding upwardly from each of the side tabs, the side tabs extending beyond the forward stops;

forward bumps protruding downwardly from a tip of each side tab; and a hook arm extending between, and substantially parallel to, the side tabs.

2. The system of claim 1, further comprising a female connector including a top side that includes:

a pair of grooved arms flexibly extending in a substantially parallel fashion from a back side of the female connector, each grooved arm including a groove that has an edge that is spaced away from an end of the grooved arm;

a slot formed by a space between the grooved arms;

a hook bar that extends between the grooved arms and is substantially perpendicular thereto, the hook bar bounding one end of the slot, whereby the hook bar may serve as a forward stop for the connection position assurance retainer in a pre-stage position and as a back stop for the connection position assurance retainer in a final stage position;

a pair of side walls, each side wall extending substantially perpendicularly from an end portion of one of the grooved arms, the hook bar extending between the end portions; and connector position assurance protector traps extending from the top side to form substantially right angles, the traps limiting movement of the grooved arms in an upward direction.

3. The system of claim 2, wherein the dovetail tab is inserted in the slot, and the back stops and the forward bumps are seated in respective ones of the grooves, the connection position assurance retainer further including a pair of lower guide tabs extending below and within, and substantially parallel to, the side tabs, wherein the lower guide tabs are also being inserted within the slot, the hook arm is engaged with the hook bar, the side tabs are inserted in respective spaces between the grooved arms and the traps, and each of the forward stops abuts one of the traps.

4. The system of claim 3, further comprising a male connector including a top side having a locking bump protruding therefrom.

5. The system of claim 4, wherein the male connector is inserted into the female connector, and the locking bump is engaged by the hook bar.

6. A connection system, comprising:

a female connector including a top side that includes:

a pair of grooved arms flexibly extending in a substantially parallel fashion from a back side of the female connector, each grooved arm including a groove that has an edge that is spaced away from an end of the grooved arm;

a slot formed by a space between the grooved arms;

a hook bar that extends between the grooved arms and is substantially perpendicular thereto, the hook bar bounding one end of the slot, whereby the hook bar may serve as a forward stop for a connection position assurance retainer in a pre-stage position and as a back stop for the connection position assurance retainer in a final stage position;

a pair of side walls, each side wall extending substantially perpendicularly from an end portion of one of the grooved arms, the hook bar extending between the end portions; and connector position assurance protector traps extending from the top side to form substantially right angles, the traps limiting movement of the grooved arms in an upward direction; and the connection position assurance retainer, including:

a dovetail tab configured to mechanically engage a dovetail slot;

a pair of back tabs on either side of, and substantially parallel to, the dovetail tab, each back tab having a back stop protruding downwardly therefrom;

a pair of side tabs that are substantially parallel to one another;

forward stops protruding upwardly from each of the side tabs, the side tabs extending beyond the forward tabs;

forward bumps protruding downwardly from a tip of each side tab; and a hook arm extending between, and substantially parallel to, the side tabs.

7. The system of claim 6, further comprising a male connector including a top side having a locking bump protruding therefrom.

8. The system of claim 7, wherein the male connector is inserted into the female connector, and the locking bump is engaged by the hook bar.

9. The system of claim 7, further comprising a male terminal inserted within the male connector, and a female terminal inserted within the female connector.

10. The system of claim 7, the male connector further including a pair of male cylinders and the female connector further including a pair of female cylinders, the system further comprising:

a first pair of cables including a first set of wires that are electrically engaged with the male terminal; and a second set of cables including a second set of wires that are electrically engaged with the female terminal.

11. The system of claim 10, further comprising at least one terminal position assurance lock disposed around one of the cables and securing the one of the cables to one of the female cylinders or one of the male cylinders, the terminal position assurance lock including:

a circumferential portion that surrounds the one of the cables, one or more lock aims engaged with one or more lock bumps on the one of the cylinders;

index ribs located about the circumferential portion and inserted into slots in the one of the cylinders; and a plurality of fingers extending from the circumferential portion and securing the one of the cables.

12. The system of claim 6, the female connector further including a top brace extending between the side walls, the top brace being further from the back side of the female connector than the hook bar.

13. The system of claim 6, wherein the dovetail tab is inserted in the slot, and the back stops and the forward bumps are seated in respective ones of the grooves.

14. The system of claim 13, the connection position assurance retainer further including a pair of lower guide tabs extending below and within, and substantially parallel to, the side tabs, the lower guide tabs also being inserted within the slot.

15. The system of claim 13, wherein the hook arm is engaged with the hook bar.

16. The system of claim 15, wherein the side tabs are inserted in respective spaces between the grooved aims and the traps.

17. The system of claim 15, wherein each of the forward stops abuts one of the traps.

18. The system of claim 6, the female terminal including a terminal insert that includes:

a pair of opposing side panels, each side panel having a plurality of flexibly indented contact arms and a set of dimples;

a pair of opposing side contact arms, each side contact arm having an inwardly curved tip; and a pair of top flanges, each top flange extending curvilinearly from a top edge of one of the side panels.

19. The system of claim 6, wherein the female connector is one of a right-angle connector and an in-line connector.

20. A terminal insert, comprising:

a pair of opposing side panels, each side panel having a plurality of flexibly indented contact arms and a set of dimples;

a pair of opposing side contact, each side contact positioned between said side panels at opposite sides thereof having an inwardly curved tip extending between said side panels;

a pair of top flanges, each flange extending curvilinearly from a top edge of one of the side panels; and a pair of side tabs, each side tab extending from one of the side panels at one side of said terminal insert and at a substantially right angle in a direction opposing a direction of the other one of the side tabs, said pair of side tabs positioned above said side contacts at said one side of said terminal insert.

* * * * *